United States Patent [19]

Duncan et al.

[11] 3,953,261

[45] Apr. 27, 1976

[54] LIQUID MONOPROPELLANT COMPOSITIONS INCLUDING HYDRAZINE AND METHOXYLAMINE HYDROCHLORIDE

[75] Inventors: William A. Duncan, Huntsville; John F. Phillips, Florence; James A. Murfree, Jr.; Walter W. Wharton, both of Huntsville, all of Ala.

[73] Assignee: The United States of America as represented by the Secretary of the Army, Washington, D.C.

[22] Filed: June 18, 1969

[21] Appl. No.: 834,618

[52] U.S. Cl. ..... 149/36; 60/218

[51] Int. Cl.[2] ..... C06D 5/10

[58] Field of Search ..... 149/36; 260/501.17; 60/218

[56] References Cited

UNITED STATES PATENTS

| | | | |
|---|---|---|---|
| 2,943,927 | 7/1960 | Audrieth et al. | 149/36 |
| 3,117,415 | 1/1964 | Greene | 149/36 X |
| 3,171,249 | 3/1965 | Bell | 149/36 X |
| 3,503,212 | 3/1970 | Jennings et al. | 60/219 |

*Primary Examiner*—Leland A. Sebastian
*Assistant Examiner*—E. A. Miller
*Attorney, Agent, or Firm*—Nathan Edelberg; Robert P. Gibson; James T. Deaton

[57] ABSTRACT

The use of methoxylamine hydrochloride ($CH_3ONH_2 \cdot HCl$) as an additive to exothermally decomposing liquid monopropellants such as hydrazine and hydrazine water mixtures to lower the freezing point of the monopropellants and thereby render the monopropellants usable in gas generators at very low temperatures.

4 Claims, No Drawings

LIQUID MONOPROPELLANT COMPOSITIONS INCLUDING HYDRAZINE AND METHOXYLAMINE HYDROCHLORIDE

BACKGROUND OF THE INVENTION

In the past, the use of liquid monopropellants in gas generators has been limited due to the freezing points of the liquid monopropellants used. It is very desirable to have a liquid monopropellant composition that can be used in a gas generator at very low temperatures as well as at high temperatures. This would render the gas generator operable in practically any natural temperature environment.

Therefore, it is an object of this invention to provide novel liquid monopropellant compositions.

Another object of this invention is to provide liquid monopropellant compositions that have freezing points that extend to the range of −40°C. to −66°C.

A further object of this invention is to provide a liquid monopropellant composition that has a low freezing point, yet the specific impulse of the liquid monopropellant is only slightly lowered due to the freezing point depressants used in the liquid monopropellant.

SUMMARY OF THE INVENTION

It has been discovered that methoxylamine hydrochloride ($CH_3ONH_2.HC1$) when used as an additive to hydrazine, to a hydrazinewater mixture or to other exothermally decomposing monopropellants produces a liquid monopropellant composition that has a freezing point which extends to the range of −40°C. to −66°C. The liquid monopropellant composition produced has good exothermic decomposing properties when used in a catalytic bed type gas generator or in a chemi-thermo bed type gas generator of the type disclosed in copending application Ser. No. 651,654 filed July 5, 1967, now U.S. Pat. No. 3,757,520.

DESCRIPTION OF THE PREFERRED EMBODIMENTS

Concentrations of methoxylamine hydrochloride in the range of 30 to 35 weight percent depress the freezing point of hydrazine from its normal value of +1°C. to a range of −40°C. to −66°C. This freezing point range is adequate for the intended use. The viscosity of a 30 weight percent solution at +21°C. is 3.2 centistokes, while at −35°C., it is 41 centistokes and is adequate for use in a gas generator.

Concentrations of methoxylamine hydrochloride of about 25 weight percent, water of about 10 weight percent and hydrazine of 65 weight percent depress the freezing point of hydrazine from its normal value of +1°C. to a range of −30°C. to −50°C. This freezing point range is adequate for certain uses. The viscosity of this solution is adequate for gas generator use.

The methoxylamine hydrochloride salt is used in hydrazine ($N_2H_4$), hydrazine water mixtures and other propellant mixtures which without the addition of methoxylamine hydrochloride would have a freezing point higher than the minimum required for the intended purpose. When water is used in the propellant mixtures, it is present in the amount of about 0 to 20 weight percent. The water acts as a freezing point depressant along with the methoxylamine hydrochloride.

The concentration of methoxylamine hydrochloride used in the solution will depend upon the freezing point range desired. For applicants' intended purpose the concentration of methoxylamine hydrochloride should be about 10 to 35 weight percent.

The methoxylamine hydrochloride-hydrazine mixture is believed to be an unknown-mixture of hydrazinium ion ($NH_2NH_3$+), methoxyl ammonium ion ($NH_3OCH_3$+) and chloride ion along with the free bases, hydrazine and methoxylamine. Consequently, the mode of compounding the fuel is not critical. Thus, while the fuel mixtures tested were made by adding hydrazine to methoxylamine hydrochloride, the same result may be attained by adding hydrogen chloride to a hydrazine-methoxylamine mixture or adding hydrazine mono- or dihydrochloride to a mixture of hydrazine and methoxylamine. If the water is used, the hydrazine and water are combined before the methoxylamine hydrochloride is added to the solution.

Because the specific impulse of methoxylamine hydrochloride is only slightly lower than hydrazine, little loss in impulse results when the hydrochloride salt is used.

We claim:

1. A liquid monopropellant composition of matter adapted for a liquid type gas generator that has a thermal bed to produce gas, said liquid monopropellant composition comprising a solution of hydrazine and methoxylamine hydrochloride, said methoxylamine hydrochloride being present in an amount of about 10 to about 35 weight percent.

2. The composition of matter of claim 1 wherein said methoxylamine hydrochloride is present in an amount of about 30 to about 35 weight percent.

3. The composition of matter of claim 1 wherein said solution includes water in an amount up to about 20 weight percent in addition to said hydrazine and said methoxylamine hydrochloride.

4. The composition of matter of claim 3 wherein said methoxylamine hydrochloride is present in an amount of about 25 weight percent, said water is present in an amount of about 10 weight percent and said hydrazine is present in an amount of about 65 weight percent.

* * * * *